United States Patent [19]

Tucker

[11] 4,139,993

[45] Feb. 20, 1979

[54] PROTECTIVE DEVICE FOR RECEIVING EARRING CLAMPING PRESSURE

[76] Inventor: Mary Y. Tucker, 506 W. Bayview Dr., Sandusky, Ohio 44870

[21] Appl. No.: 762,434

[22] Filed: Jan. 24, 1977

[51] Int. Cl.[2] ..... A44C 7/00

[52] U.S. Cl. ..... 63/14 B; 63/12

[58] Field of Search ..... 63/12, 13, 14 R, 14 A–14 G

[56] References Cited

U.S. PATENT DOCUMENTS

| | | | |
|---|---|---|---|
| 119,530 | 10/1871 | Northrup | 63/12 |
| 161,853 | 4/1875 | Baker | 63/12 |
| 206,103 | 7/1878 | Gederen | 63/12 X |
| 1,971,216 | 10/1934 | Gould | 63/14 B |
| 2,713,863 | 7/1955 | Handerson | 128/330 |
| 2,878,660 | 3/1959 | Schweikert | 63/14 A |

*Primary Examiner*—F. Barry Shay

[57] ABSTRACT

The Earring Stay is a piece of jewelry similar to an earring in size, shape and composition. It differs from the conventional earring in that the two sections, when inserted into a pierced ear lobe, form a comfortable platform on each side of the ear lobe. Screw-on earrings can then be anchored securely to these platforms. The Earring Stay consists of two parts, one a hollow tube threaded on the inside, and connected to a thin disk, the other a threaded shaft connected to another thin disk. And these disks are the platforms of the Earring Stay. One of the platforms is provided with means, such as a circumferential lip, to prevent the screw-on earring from slipping off the platform.

1 Claim, 2 Drawing Figures

PROTECTIVE DEVICE FOR RECEIVING EARRING CLAMPING PRESSURE

Figure 1:
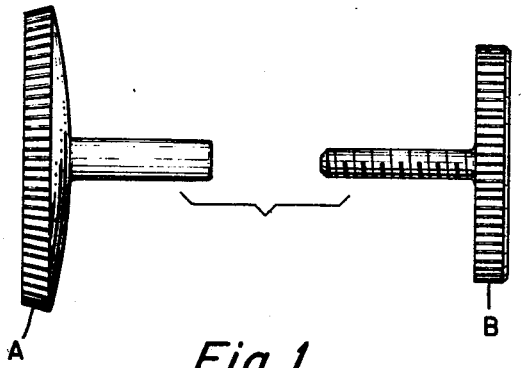
Figure 2:
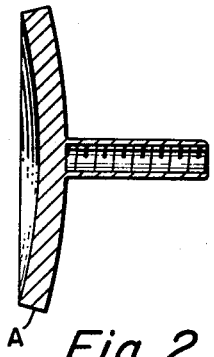

The Earring Stay can be made of any suitable metal, such as white or yellow gold, silver, platinum, a less expensive metal, or a hypo-allergenic metal. It consists of two sections:

1. Female section "A" which inserts into the opening of a pierced ear lobe from the front of the ear.

2. Male section "B" which screws into the front section from the back of the ear, thus creating a secure circular platform (disk) on each side of the ear lobe. screw-on type earrings can now be tightly attached and worn for hours without discomfort, or fear of losing an earring.

Drawing of Earring Stay accompanying this patent application shows the two component parts, sections "A" & "B" as seen from the side, and a cross section of Section "A" showing threads inside the hollow tube part of section "A".

Female section "A" consists of a hollow tube 1/10 Centimeter in diameter, and 5/20 Centimeter long. The tube portion of section "A" is smooth outside, and threaded inside. The free end of female tube "A" is smooth, and bevelled for ease in directing it through the pierced ear lobe opening. The hollow space inside tube portion is of a sufficient diameter to allow threaded shaft of section "B" to be screwed inside the "A" tube. The closed end of female tube "A" is attached to the center of a thin circular disk which is slightly concave on the unattached outside surface. Total length of female section "A", hollow tube and disk, is 3/10 Centimeter. The disk portion of section "A" is 1/20 Centimeter thick, and 5/10 Centimeter in diameter, and is smoothly serrated around its circumference for ease in handling. The combined length of tube and disk of section "A" is 3/10 Centimeter.

Male section "B" consists of a solid threaded shaft about 5/20 Centimeter long, (length depends on discretion of Mfg. The threading is on the outside of this shaft. The diameter of this shaft must be suitable to allow it to be screwed into female tube "A". The free end of male shaft "B" is smoothly rounded to prevent damage to the ear lobe if it should slip while being fitted into female section "A". The closed end of male shaft "B" is connected to the center of a thin disk 1/20 Centimeter thick and 4/10 Centimeter in diameter. This disk too is smoothly serrated around its outside circumference, for ease in handling. And the outer surface of this disk has a saucer like rim or lip around its outside circumference, the latter serving as a means for positively preventing the screw-on part of a screw-on earring from sliding off the disk once the earring has been tightly attached. The total length of the shaft and disk of male part "B" must not exceed 3/10 Centimeter, as the combined length of female part "A" and male part "B" when joined together, including the thickness of their disks, must not exceed 7/20 Centimeter. The 7/20 Centimeter length of the joined Earring Stay parts is thus compatible with the usual distance between a screw-on ear ornament and the disk covering the screw portion which ordinarily pinches a screw-on earring to the ear lobe. The outside diameter of female tube "A" must not be greater than 1/10 Centimeter, as most pierced ear lobe openings can admit a tube of this size. But the inside diameter of female tube "A", including its threads, and the outside diameter of shaft "B" is left to the discretion of the manufacturer in order to eliminate expense of retooling if the manufacturer already has instruments or machines for making so small a threaded shaft and threaded hollow tube.

I claim invention of a new earring stay device as follows:

1. An earring stay comprising an article similar to an earring in size, shape, and composition, said article including a female section having a tube with a smooth exterior surface and a diameter adapting it for insertion into the aperture in the lobe of a pierced human ear, said tube having an opening at one end and having secured at its other end a platform adapted to overlie the outer lobe surface adjacent one end of said lobe aperture; a male section having a shaft of a size to be received within said tube through said open end and having secured at one end thereof a platform adapted to overlie the lobe surface adjacent the other end of said lobe aperture, and threads on the interfitting portions of said tube and shaft for securing them in interfitting relation, one of said platforms having means thereon for positively preventing the movable part of a screw-on earring clamp from sliding off the platform, whereby when said earring stay is mounted in said aperture, a screw-on type earring may be tightly attached to the earring stay without discomfort or fear of loss.

* * * * *